US010695942B2

(12) United States Patent
Shimizu et al.

(10) Patent No.: US 10,695,942 B2
(45) Date of Patent: Jun. 30, 2020

(54) STAPLER

(71) Applicant: MAX CO., LTD., Tokyo (JP)

(72) Inventors: Toshio Shimizu, Tokyo (JP); Futoshi Kameda, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 359 days.

(21) Appl. No.: 15/786,654

(22) Filed: Oct. 18, 2017

(65) Prior Publication Data

US 2018/0117787 A1 May 3, 2018

(30) Foreign Application Priority Data

Oct. 31, 2016 (JP) ..... 2016-213886

(51) Int. Cl.

| | |
|---|---|
| ***B27F 7/19*** | (2006.01) |
| ***B25C 5/02*** | (2006.01) |
| ***B27F 7/36*** | (2006.01) |
| ***B27F 7/00*** | (2006.01) |
| *B27F 7/38* | (2006.01) |
| *G03G 15/00* | (2006.01) |

(52) U.S. Cl.

CPC ..... *B27F 7/19* (2013.01); *B25C 5/0207* (2013.01); *B27F 7/006* (2013.01); *B27F 7/36* (2013.01); *B27F 7/38* (2013.01); *B65H 2403/51* (2013.01); *G03G 15/6544* (2013.01); *G03G 2215/00827* (2013.01)

(58) Field of Classification Search

CPC ..... B23C 5/0207; B27F 7/19; B27F 7/006; B27F 7/36

USPC ..... 227/155

See application file for complete search history.

(56) References Cited

U.S. PATENT DOCUMENTS

| | | | | |
|---|---|---|---|---|
| 4,844,319 | A * | 7/1989 | Kurosawa | B27F 7/19 227/79 |
| 5,516,025 | A * | 5/1996 | Eriksson | B25C 5/0207 227/155 |
| 6,981,626 | B1 * | 1/2006 | Tsai | B25C 5/0207 227/155 |

(Continued)

FOREIGN PATENT DOCUMENTS

| | | |
|---|---|---|
| EP | 2 540 447 A2 | 1/2013 |
| JP | S61-105583 U | 7/1986 |

(Continued)

OTHER PUBLICATIONS

Extended European Search Report issued by the EP Patent Office dated Apr. 20, 2018.

*Primary Examiner* — Robert F Long
*Assistant Examiner* — Xavier A Madison
(74) *Attorney, Agent, or Firm* — Rothwell, Figg, Ernst & Manbeck, P.C.

(57) ABSTRACT

A stapler includes a staple striking portion configured to strike a staple to penetrate sheets of paper and a clincher portion configured to bend staple legs of the staple penetrating the sheets of paper. The clincher portion includes a pair of clinchers. The pair of clinchers are configured to perform a first operation and a second operation. In the first operation, the pair of the clinchers move along a surface direction of the sheets of paper to approach each other. In the second operation, the pair of clinchers move to approach the sheets of paper after the first operation.

18 Claims, 8 Drawing Sheets

(56) References Cited

U.S. PATENT DOCUMENTS

| | | | | |
|---|---|---|---|---|
| 7,014,091 | B2 * | 3/2006 | Mochizuki | B27F 7/36 227/120 |
| 2006/0266789 | A1 * | 11/2006 | Tsai | B25C 5/0207 227/155 |
| 2007/0034665 | A1 | 2/2007 | Shimizu et al. | |
| 2008/0135599 | A1 * | 6/2008 | Kishi | B27F 7/19 227/155 |
| 2010/0096430 | A1 * | 4/2010 | Sugihara | B27F 7/19 227/155 |

FOREIGN PATENT DOCUMENTS

| | | | |
|---|---|---|---|
| JP | H11-20764 | A | 8/1999 |
| JP | 2005-119246 | A | 5/2005 |
| WO | WO 99/41049 | A1 | 8/1999 |

* cited by examiner

STAPLER

CROSS-REFERENCE TO RELATED APPLICATION

This application claims priority from Japanese Patent Application No. 2016-213886 filed on Oct. 31, 2016, the entire contents of which are incorporated herein by reference.

TECHNICAL FIELD

The present invention relates to a stapler for binding a plurality of sheets of paper with a staple.

BACKGROUND

In electric staplers used in post-processing devices, a clincher mechanism is typically equipped for bending staple legs of a staple, which penetrate sheets of paper, along a surface the sheets of paper (e.g., see Japanese Utility Application Publication No, Sho 61-105583). However, in conventional staplers, the staple legs of the staple penetrating the sheets of paper are likely not to be properly bent onto the sheets of paper, so that a poor binding, such as buckling of staple legs, reverse bending, rising-up of staple legs or lifting of staple legs, is occurred.

Thus, in order to inhibit a poor binding, a stapler, in which a pair of clincher mechanism configured to bend staple legs by a pivoting motion thereof are provided, is disclosed from Japanese Patent Application Publication No. Hei 11-207654 and Japanese Patent Application Publication No. 2005-119246.

In the clincher mechanism configured to bend staple legs by a pivoting motion as describe above, it is necessary to position pivot fulcrums of clinchers to locations, which are near to the middle of the stapler in a width direction thereof and also spaced from the sheets of paper, in order to inhibit a poor binding and thus to properly bend the staple legs. However, if the pivot fulcrums of the clinchers are spaced from the sheets of paper, there is a problem that a height of the clincher mechanisms is increased and thus a height of the entire stapler is also increased.

Accordingly, the present invention has been made to solve the above problems, and an object thereof is to provide a stapler in which it is possible to realize a stabilized bent shape of staple legs and also to keep a height of the stapler lower.

SUMMARY

In order to solve the above object, the present invention is a stapler, including a staple striking portion for striking a staple to penetrate sheets of paper; and a clincher portion for bending staple legs of the staple penetrating the sheets of paper; wherein the clincher portion includes a pair of clinchers; wherein the pair of clinchers are configured to perform a first operation, in which the pair of the clinchers move along a surface direction of the sheets of paper to approach each other, and a second operation, in which the pair of clinchers move to approach the sheets of paper, after the first operation.

Also, the present invention is a stapler suitable for a post-processing device having a stapler for binding sheets of paper with a staple and configured to perform a post-processing on sheets of paper with an image formed thereon, wherein the stapler includes a staple striking portion for striking a staple to penetrate sheets of paper, and a clincher portion for bending staple legs of the staple penetrating the sheets of paper; wherein the clincher portion includes a pair of clinchers; wherein the pair of clinchers are configured to perform a first operation, in which the pair of the clinchers move along a surface direction of the sheets of paper to approach each other, and a second operation, in which the pair of clinchers move to approach the sheets of paper, after the first operation.

Further, the present invention is a stapler suitable for an image formation system including an image formation device configured to form an image on a sheet of paper and then to output the sheet of paper, and the post-processing device as described above connected to the image formation device and configured to perform a post-processing on the sheets of paper.

According to the present invention, the pair of clinchers bend the staple legs of the staple penetrating the sheets of paper by the first operation, in which the pair of the clinchers move along the surface direction of the sheets of paper to approach each other, and the second operation, in which the pair of clinchers move to approach the sheets of paper.

According to the present invention, it is possible to realize a stabilized bent shape of the staple legs. Also, it is possible to keep a height of the clincher portion lower, thereby keeping a height of the stapler lower.

DETAILED DESCRIPTION

Hereinafter, embodiments of a stapler according to the present invention, a post-processing device having the stapler mounted thereon and an image formation system having the post-processing device will be described with reference to the accompanying drawings.

<Exemplary Configuration of Image Formation System and Post-Processing Device>

Figure 1:
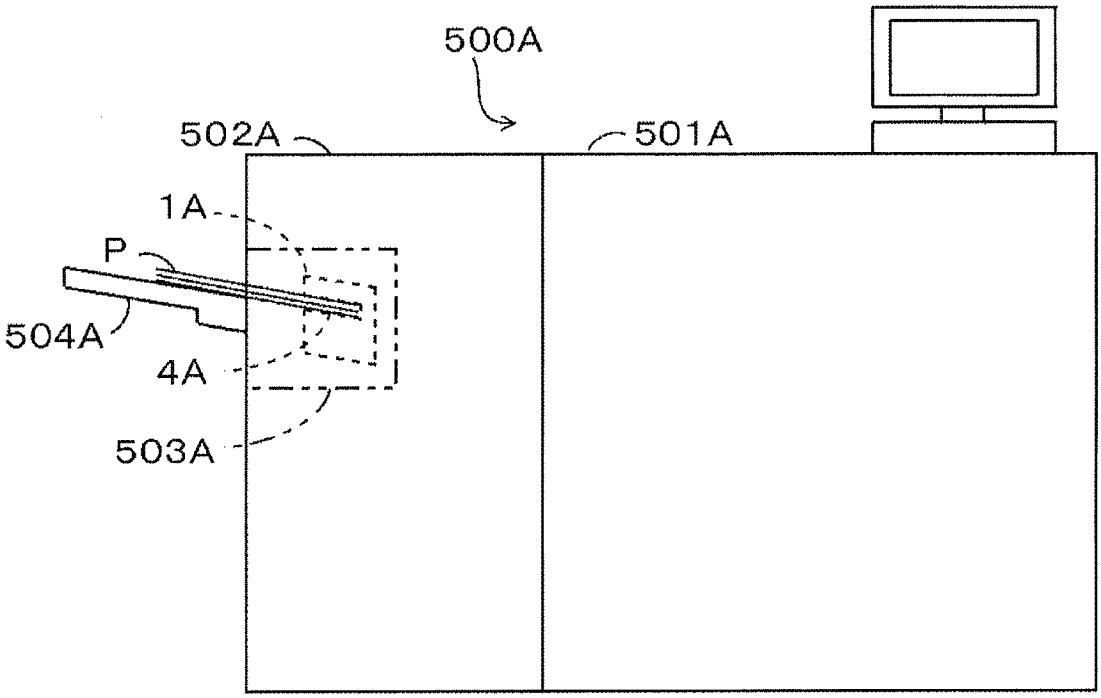
FIG. 1 is a configuration view showing an outline of an image formation system of the present embodiment.
Figure 2:
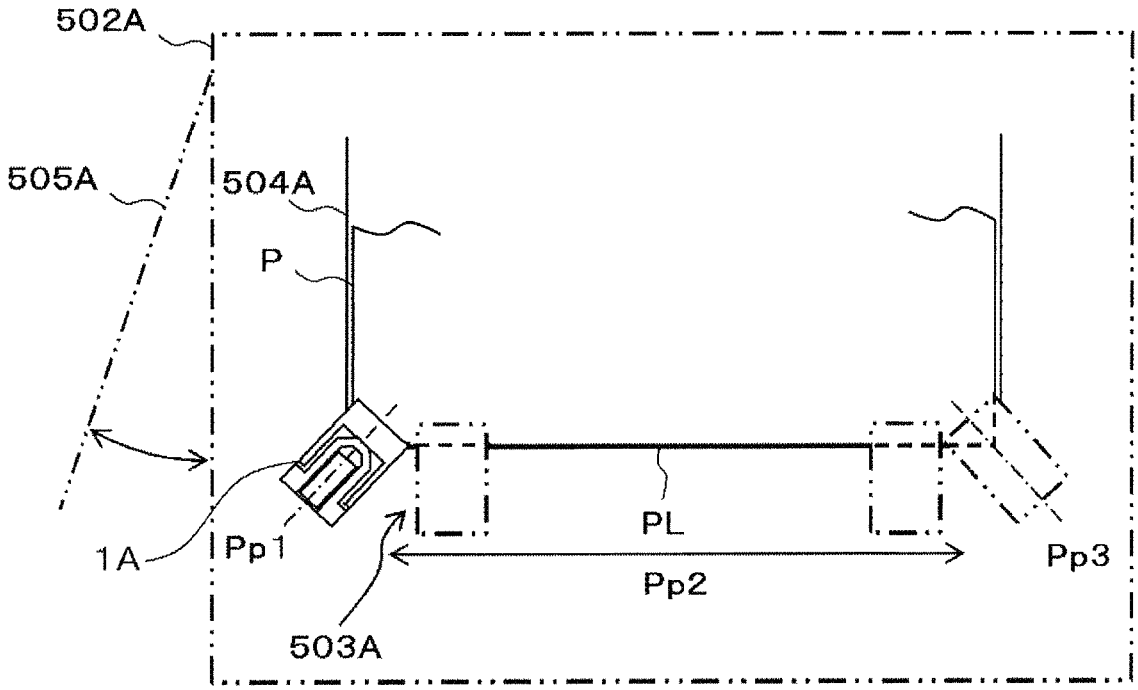
FIG. 2 is configuration view showing one example of a post-processing device of the present embodiment.

FIG. 1 is a configuration view showing an outline of an image formation system of the present embodiment, and FIG. 2 is a configuration view showing one example of a post-processing device of the present embodiment.

The image formation system 500A of the present embodiment has an image formation device 501A and a post-processing device 502A capable of performing at least one kind of processing. The image formation device 501A is configured to form an image on a sheet of paper P fed from a paper feeding portion (not shown), which is provided inside or outside the device, and then to output the sheet of paper P. In the present example, the image formation device 501A is configured to form an image on the sheet of paper P by forming an electrostatic latent image by scanning exposure, developing the electrostatic latent image by a toner, and then transferring and fixing the toner onto the sheet of paper.

The post-processing device 502A of the present embodiment has a stapler 1A, as described below, on a binding portion 503A thereof. The binding portion 503A has a stacking portion 504A in which sheets of paper P outputted from the image formation device 501A are stacked.

FIG. 2 is a view of the binding portion 503A of the post-processing device 502A as viewed from an upper side of the paper surface in FIG. 1. The stapler 1A is configured to be moved to a first position Pp1 where the sheets of paper P stacked in the stacking portion 504A are bound at one corner, a second position Pp2 where the sheets of paper P are bound at any location along a side PL thereof, and a third position Pp3 where the sheets of paper P are bound at another corner, by a moving unit (not shown). In the present example, the position Pp1 also serves as a reference position, which is a home position (HP), and an openable and closable door 505A is provided near thereto.

<Exemplary Operation of Binding Sheets of Paper with Staple>

FIG. 3 is an explanatory view showing one example of an operation of binding sheets of paper with a staple. As shown in FIG. 3A, a staple 10A has staple legs 12A formed by bending both ends of a staple crown 11A toward one direction. That is, the staple 10A is shaped in a generally U-shape.

Figure 3A:
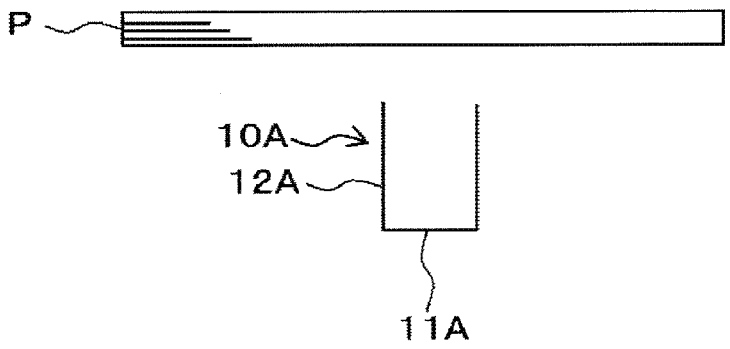
FIGS. 3A to 3D are explanatory views showing one example of an operation of binding sheets of paper with a staple.
Figure 3B:
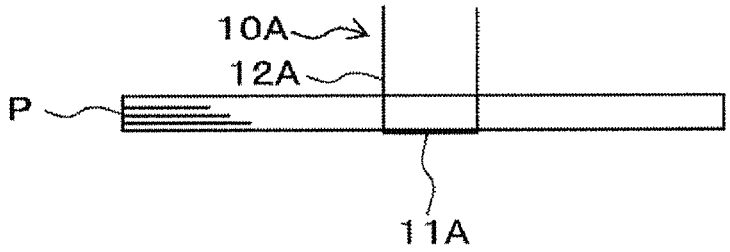
Figure 3C:
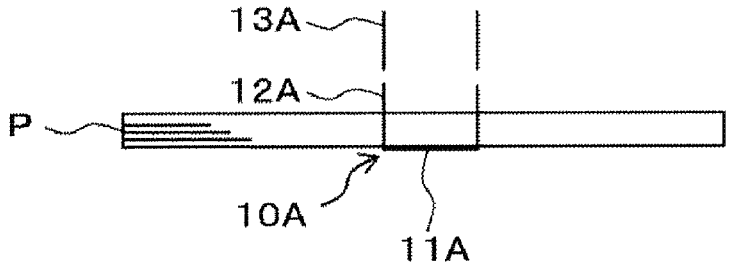

As shown in FIG. 3B, the staple 10A is configured such that as the staple crown 11A is pressed, the staple legs 12A penetrate sheets of paper P and then the staple crown 11A comes in contact with the sheets of paper P. In the staple 10A of which the staple legs 12A have penetrated the sheets of paper P, as shown in FIG. 3C, surplus parts of the staple legs 12A which are to overlap with each other when the staple legs 12A are bent are cut as cut staples 13A. Meanwhile, a configuration for receiving the cut staples 13A cut from the staple legs 12A will be described below.

Figure 3D:
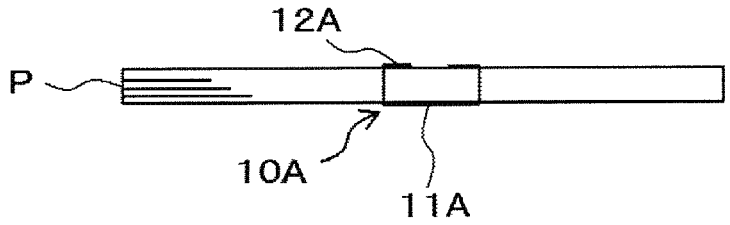

In the staple 10A of which the staple legs 12A have been cut into a predetermined length, as shown in FIG. 3D, the staple legs 12A penetrating the sheets of paper P are bent and thus the sheets of paper P are bound with the staple 10A.

Exemplary Configuration of the Present Embodiment

Figure 4:
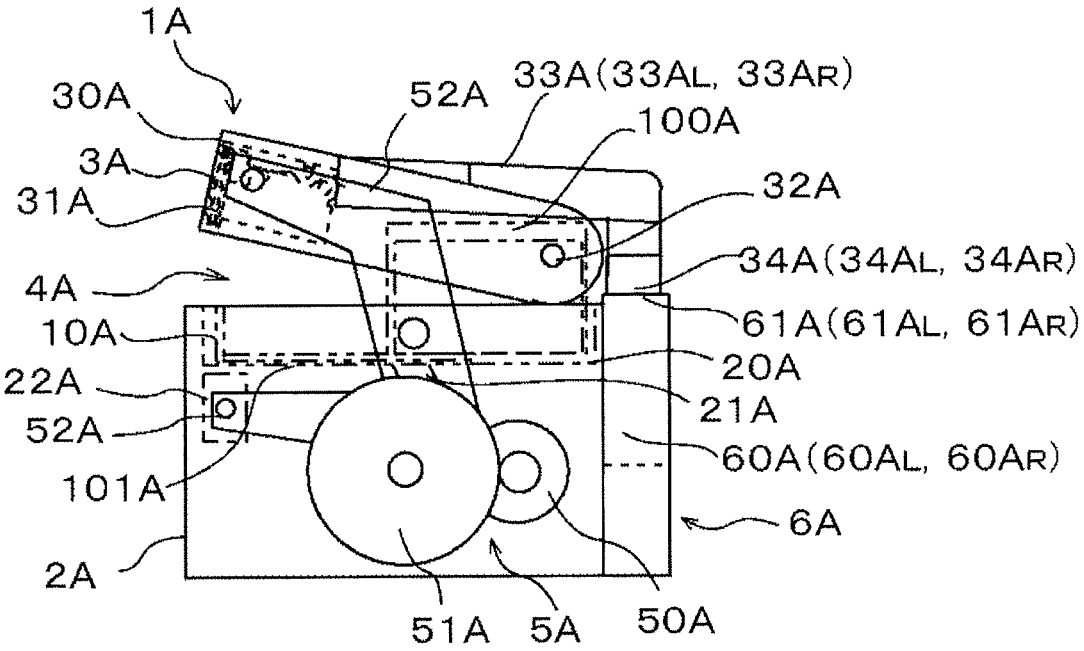
FIG. 4 is a side view showing one example of a stapler of the present embodiment.
Figure 5:
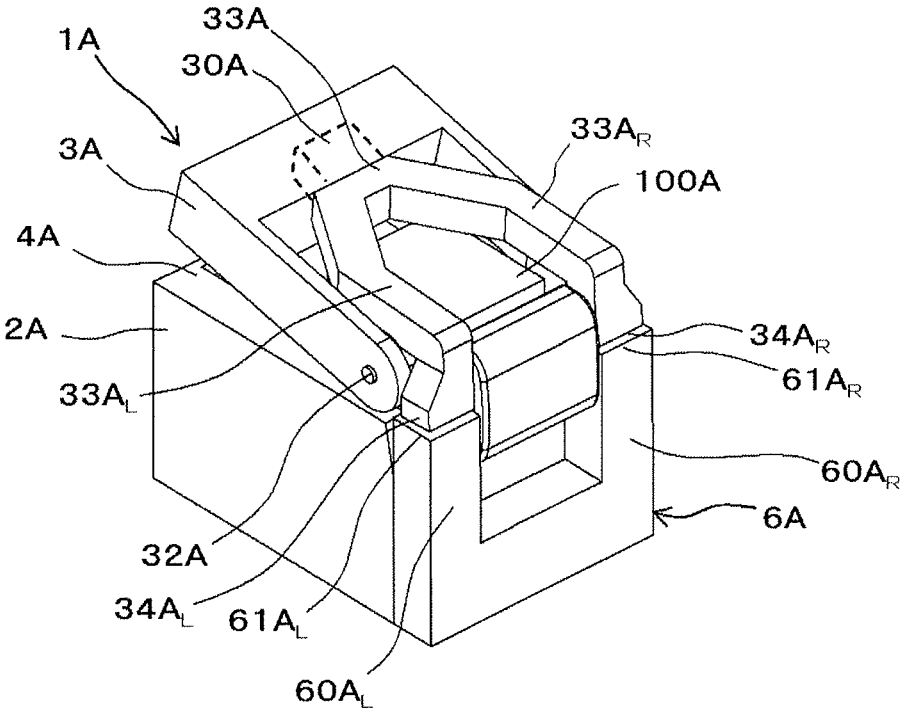
FIG. 5 is a perspective view showing the example of the stapler of the present embodiment.

FIG. 4 is a side view showing one example of a stapler of the present embodiment, and FIG. 5 is a perspective view showing the example of the stapler of the present embodiment.

The stapler 1A of the present embodiment includes a staple striking unit 2A for supplying and striking a staple 10A, and a binding unit 3A for binding sheets of paper P with the staple 10A by cutting staple legs 12A of the staple 10A as shown in FIG. 3C and then bending the staple legs 12A as shown in FIG. 3D in cooperation with the staple striking unit 2A.

The staple striking unit 2A is an example of a staple striking portion and has a receiving portion 20A configured to allow a staple cartridge 100A, which is a staple receiving portion in which staples 10A are received, to be removably attached thereon, a feeding portion 21A for feeding a staple 10A from the staple cartridge 100A, and a striking portion 22A for driving the staple 10A into sheets of paper P.

In the present example, staples 10A are provided as a staple sheet 101A, in which a plurality of linear staples 10A are integrated by bonding, and a plurality of staple sheets 101A are stacked and received in the staple cartridge 100A. The striking portion 22A is configured to strike one staple 10A of the staple sheet 101A, which is located at the most leading end in a conveying direction thereof, and at the same time to shape a second, and possibly a third, staple 10A into a generally U-shape as shown in FIG. 3A and the like. Alternatively, the staple cartridge 100A may be supplied in a form in which staple sheets 101A are stored in a detachable refill.

The binding unit 3A is an example of a binding portion. The biding unit 3A has a cutting portion 30A and clincher portion 31A. The cutting portion 30A is configured to cut staple legs 12A of the staple 10A, which have penetrated sheets of paper P, into a predetermined length. The clincher portion 31A is configured to bend the staple legs 12A of the staple 10A, which have penetrated the sheets of paper P and have been cut into the predetermined length, toward the sheets of paper P. The clincher portion 31A is provided at a location opposing the striking portion 22A for the stapler 10A. The cutting portion 30A is arranged at a location close to the clincher portion 31A.

The stapler 1A has a paper clamping portion 4A for clamping sheets of paper P between the staple striking unit 2A and the binding unit 3A. The paper clamping portion 4A is provided on one side of the stapler 1A, on which the striking portion 22A of the staple striking unit 2A and the clincher portion 31A of the binding unit 3A are provided.

In the post-processing device 502A, as shown in FIG. 1, sheets of paper P are aligned and stacked using an inclination of the stacking portion 504A. Therefore, the stapler 1A is mounted to be inclined in such a direction that an opening thereof; through which the sheets of paper P are inserted into and withdrawn from the paper clamping portion 4A, is oriented upward, or is horizontally mounted.

As shown in FIG. 2, the stapler 1A is moved inside the post-processing device 502A due to changing of binding positions and the like, and thus an orientation thereof is not kept constant. Therefore, a side on which the paper clamping portion 4A is provided is referred to as a front side of the stapler 1A, and a side opposite to the side on which the paper clamping portion 4A is provided is referred to as a rear side thereof. Also, a side on which the binding unit 3A is provided is referred to as an upper side of the stapler 1A, and a side on which the staple striking unit 2A is provided is referred to as a lower side of the stapler 1A.

The paper clamping portion 4A has a shape, which is opened on front, right and left sides of the stapler 1A, so that a binding location on the sheets of paper P at which the sheets of paper P are bound with the staple 10A can be positioned between the striking portion 22A and the clincher portion 31A.

The stapler 1A has a drive unit 5A for driving the feeding portion 21A and the striking portion 22A of the staple striking unit 2A, the binding unit 3A, the cutting portion 30A and the clincher portion 31A of the binding unit 3A.

The drive unit 5A has a cam 51A driven by a motor 50A provided in the staple striking unit 2A, a link portion 52A for transferring an operation of the cam 51A to each part, and the like According to the stapler 1A, as an operation of the cam 51A is transferred to the binding unit 3A via the link portion 52A and the like, the staple striking unit 2A and the binding unit 3A are moved relative to each other in separating/contacting directions, in which they separate from and contact with each other. In the present example, the binding unit 3A is moved relative to the staple striking unit 2A in the separating/contacting directions by a rotation operation thereof about a shaft 32A.

According to the stapler 1A, the binding unit 3A is moved in a direction approaching the staple striking unit 2A by an operation, in which the cam 51A rotates in one direction, and thus the paper clamping portion 4A clamps sheets of paper P at a predetermined timing. Also, according to the stapler 1A, the binding unit 3A is moved in a direction separating from the staple striking unit 2A at a predetermined timing by an operation, in which the cam 51A further rotates in one direction, and thus clamping of the sheets of paper P by the paper clamping portion 4A is released.

Further, according to the stapler 1A, an operation of the cam 51A is transferred to the feeding potion 21A and the striking portion 22A via the link portion 52A and the like. Therefore, due to an operation in which the cam 51A rotates in one direction, staples 10A received in the staple cartridge 100A are fed by the feeding portion 21A, and then one of the fed staples 10A, which is located at the most leading end thereof, is driven into sheets of paper P, which are clamped by the paper claiming portion 4A, by the striking portion 22A. As a result, staple legs 12A of the staple 10A penetrate the sheets of paper P. Also, shaping of a second, and possibly a third, staple 10A is performed.

Further, according to the stapler 1A, an operation of the cam 51A is also transferred to the cutting portion 30A and the clincher portion 31A via the link portion 52A and the like. Therefore, due to an operation in which the cam 51A rotates in one direction, the staple legs 12A of the staple 10A penetrating the sheets of paper P are cut into a predetermined length by the cutting portion 30A, and then the staple legs 12A of the staple 10A, which have been cut into the predetermined length, are bent by the clincher portion 31A.

The stapler 1A has a cut staple receiving portion 6A for receiving cut staples 13A cut by the cutting portion 30A. The cut staple receiving portion 6A is removably attached on the stapler 1A on a rear side of the stapler 1A opposite to a side thereof, on which the paper clamping portion 4A is provided.

The cut staple receiving portion 6A has two collecting paths 60$A_L$, 60$A_R$. When the cut staple receiving portion 6A is attached on the stapler 1A, the two collecting paths 60$A_L$, 60$A_R$ are arranged on both sides of the receiving portion 20A, so that an attaching and detaching path, along the staple cartridge 100A is attached on and detached from the receiving portion 20A, is not blocked.

The cut staple receiving portion 6A is sized such that even if staple legs 12A of the maximum number of staples 10A which can be received in the stapler cartridge 100A are cut into the maximum length, all the cut staples 13A can be received therein.

Also, the cut staple receiving portion 6A is configured such that regardless of positions of the stapler 1A inside the post-processing device 502A, a main body portion of the cut staple receiving portion 6A are positioned below either or both of the collecting path 60$A_L$ or the collecting path 60$A_R$.

The stapler 1A has a discharging path 33A provided in the binding unit 3A for guiding the cut staples 13A, which are cut by the cutting portion 30A, to the cut staple receiving portion 6A. In the present embodiment, the discharging path 33A is configured such that one discharging path 33A communicated with the cutting portion 30A is divided into two discharging paths 33$A_L$, 33$A_R$, which are arranged on both sides of the receiving portion 20, thereby preventing an attaching and detaching path, along which the staple cartridge 100A is attached on or detached from the receiving portion 20A, from being blocked.

In the stapler 1A, a discharging port 34$A_L$ of one discharging path 33$A_L$, is communicated with a collecting port 61$A_L$ of one collecting path 60$A_L$ of the cut staple receiving portion 6A, and a discharging port 34$A_R$ of the other discharging path 33$A_R$ is communicated with a collecting port 61$A_R$ of the other collecting path 60$A_R$ of the cut staple receiving portion 6A.

Therefore, a cut staple 13A passing though the one discharging path 33$A_L$ from the cutting portion 30A is collected in the cut staple receiving portion 6A by passing through the collecting path 60$A_L$ via the collecting port 61$A_L$. Also, a cut staple 13A passing though the other discharging path 33$A_R$ from the cutting portion 30A is collected in the cut staple receiving portion 6A by passing through the collecting path 60$A_R$ via the collecting port 61$A_R$.

The discharging path 33 is configured such that regardless of positions of the stapler 1A inside the post-processing device 502A, the discharging ports 34$A_L$ and/or 34$A_R$ of at least one of the discharging path 33$A_L$ and the discharging path 33$A_R$ is lower than the cutting portion 30A.

The discharging path 33A (33$A_L$, 33$A_R$) is provided in the binding unit 3A and thus is moved by a rotation operation of the binding unit 3A about the shaft 32A. In contrast, the cut staple receiving portion 6A is attached on the staple striking unit 2A and is not moved relative to the binding unit 3A.

Therefore, the discharging port 34$A_L$, of the one discharging path 33$A_L$ and the discharging port 34$A_R$ of the other discharging path 33$A_R$ are arranged near to the shaft 32, so that an amount of movement of the discharging port 34$A_L$, 34$A_R$ due to a rotation operation of the binding unit 3A about the shaft 32A is kept small.

Also, the discharging port 34$A_L$ of the one discharging path 33$A_L$ is configured to enter the one collecting port 61$A_L$ of the cut staple receiving portion 6A and also to be moveable within a range of an opening of the collecting port 61$A_L$. Similarly, the discharging port 34$A_R$ of the other discharging path 33$A_R$ is configured to enter the other collecting port 61$A_R$ of the cut staple receiving portion 6A and also to be moveable within a range of an opening of the collecting port 61$A_R$.

Figure 6:
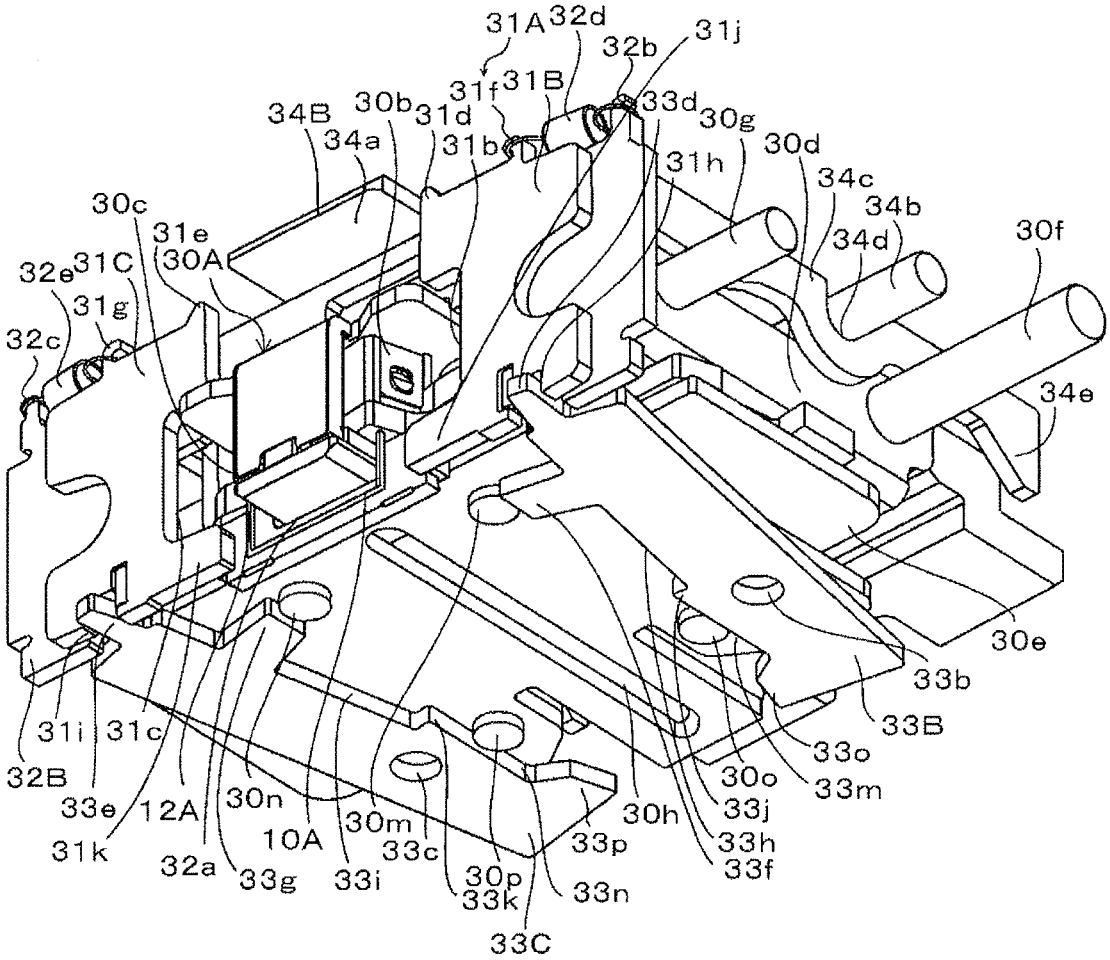
FIG. 6 is a perspective view showing one example of a cutting portion and a clincher portion.
Figure 9A:
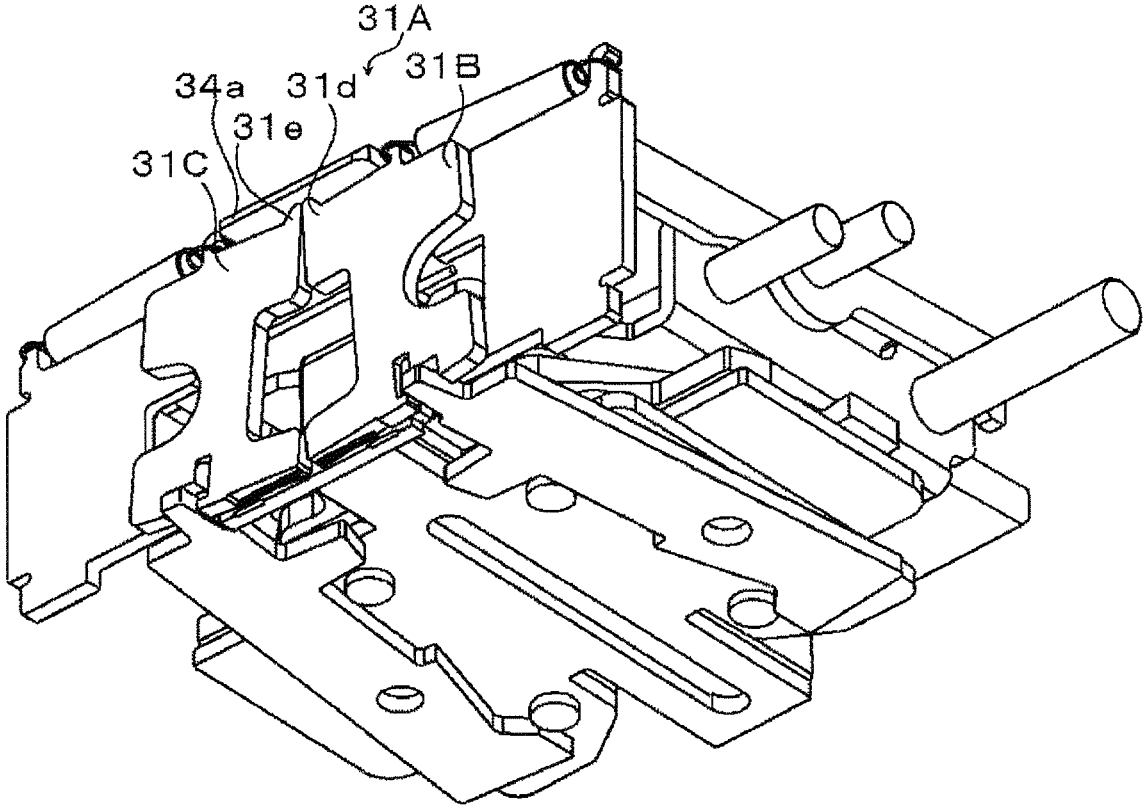
FIGS. 9A and 9B are explanatory views showing an exemplary operation of the clincher portion.
Figure 9B:
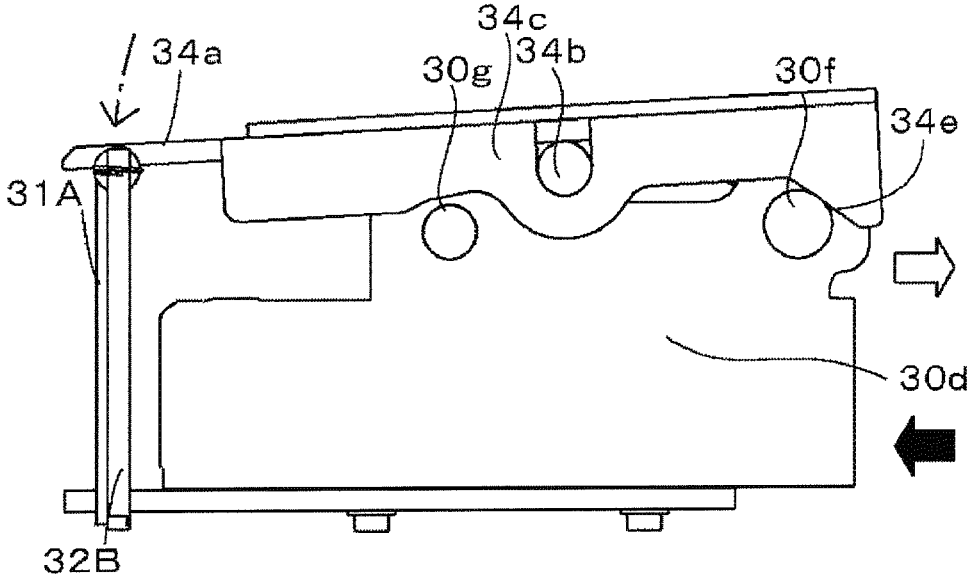
Figure 10A:
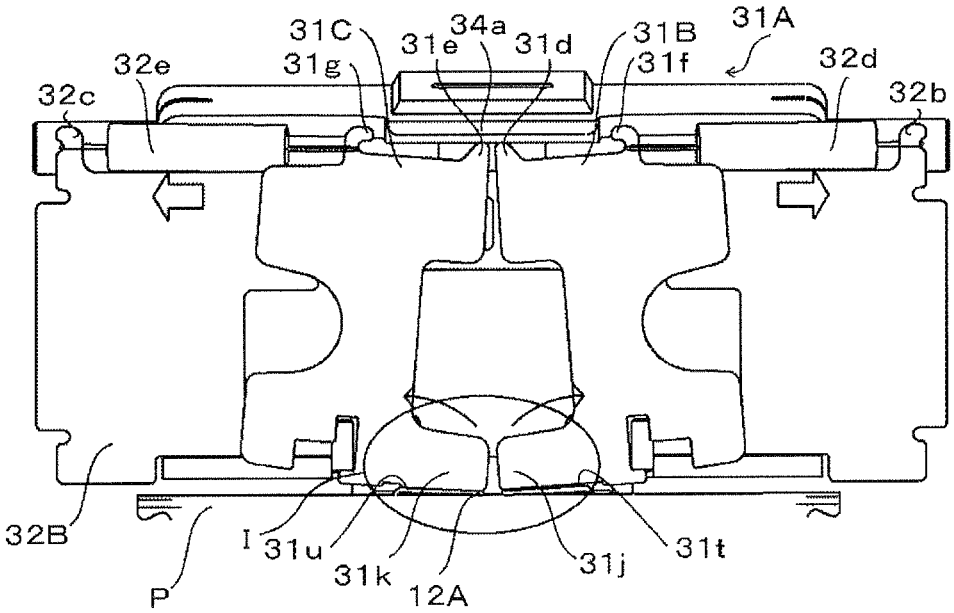
FIGS. 10A and 10B are explanatory views showing an exemplary operation of the clincher portion.
Figure 10B:
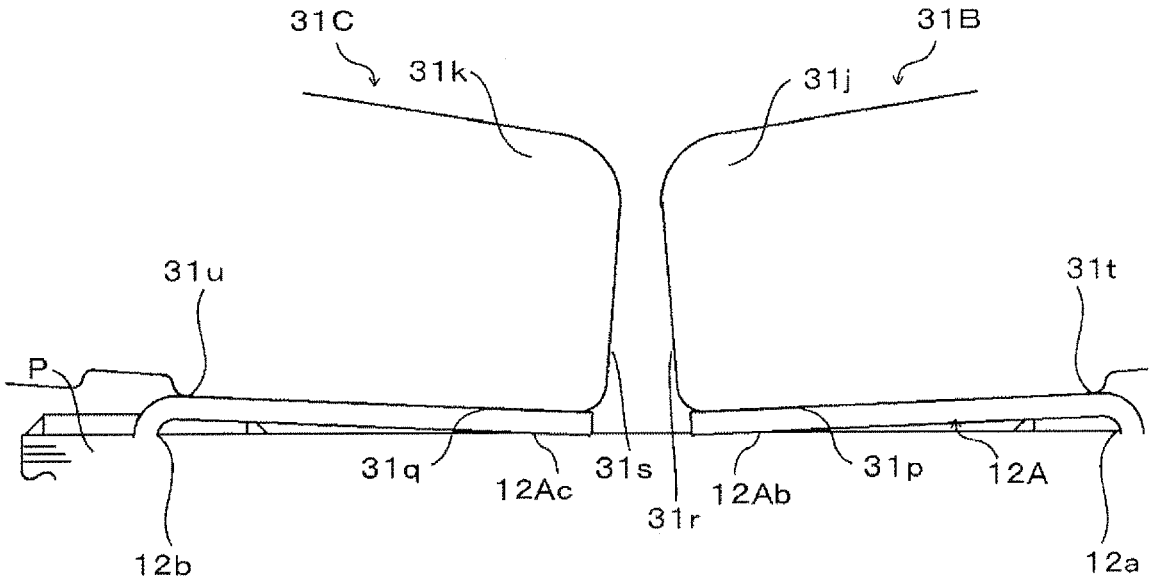

Exemplary Configuration of Cutting Portion and Clincher Portion of the Present Embodiment FIG. 6 is a perspective view showing one example of the cutting portion and the clincher portion of the present embodiment, FIGS. 7A to 7C and 8A to 8C are a perspective view, a side view and a schematic front plan view showing an exemplary operation of the cutting portion and the clincher portion of the present embodiment. FIGS. 9A and 9B are perspective view and a side view showing an exemplary operation of the clincher portion. FIGS. 10A and 10B are front plan views showing an exemplary operation of the clincher portion. Meanwhile, for convenience of explanation, sheets of paper P are omitted in FIGS. 7A, 8A and 9A.

As shown in FIG. 6, the cutting portion 30A of the present embodiment has a staple leg cutting member 30*b*, 30*c* for cutting surplus parts of staple legs 12A, and a moving member 30*d* for moving the staple leg cutting member 30*b*, 30*c*.

Also, the clincher portion 31A of the present embodiment has a pair of clinchers 31B, 31C for bending the staple legs 12A along a surface direction of sheets of paper P, a support plate 32B for movably supporting the clinchers 31B, 31C, a clincher link 33B for moving the clincher 31B, a clincher link 33C for moving the clincher 31C, and a pressing portion 34B for pressing upper portions of the clinchers 31B, 31C while the clinchers 31B, 31C are close to each other.

As shown in FIG. 3B, the staple leg cut members 30*b*, 30*c* are configured to cut staple legs 12A of a staple 10A, which are formed by bending both ends of a staple crown 11A toward one direction and penetrate sheets of paper P, into a predetermined length suitable to the number of sheets of paper P.

The moving member 30*d* has a support plate 30*e* provided on a bottom surface of the cutting portion 30A and moving shafts 30*f*, 30*g* provided on sides of the cutting portion 30A.

The support plate 30*e* has a long hole 30*h* provided at the center thereof to extend in a direction perpendicular to the support plate 32B, and protrusions 30*m*, 30*n*, 30*o*, 30*p* protruding downward from the support plate 30*e*. An attachment member (not shown) is attached on the moving member 30*d*, and the attachment member is also attached on the binding unit 3A through the inside of the long hole 30*h*, so that the moving member 30*d* can move along the long hole 30*h*. The protrusions 30*m*, 30*n*, 30*n*, 30*o* are arranged at equal distances from the long hole 30*h*. The protrusions 30*m*, 30*n* are positioned to be perpendicular to the long hole 30*h* and also for the long hole 30*h* to be positioned therebetween, and the protrusions 30*o*, 30*p* are positioned to be perpendicular to the long hole 30*h* and also for the long hole 30*h* to be positioned therebetween. The protrusions 30*m*, 30*n* protrude from the vicinity of a front surface of the support plate 32B, and the protrusions 30*o*, 30*p* protrude from locations, which are located more rearward than the protrusions 30*m*, 30*n*.

Each of the moving shafts 30*f*, 30*g* is operatively connected to the link portion 52A via a link member (not shown), so that an operation of the cam 51A is transferred to the moving shafts 30*f*, 30*g*. When the drive unit 5A drives the cam 51A, the moving shafts 30*f*, 30*g* are moved forward and backward in a direction perpendicular to the support plate 32B via the link portion 52A and the like. As the moving shafts 30*f*, 30*g* are moved forward and backward, the cutting portion 30A is also moved forward and backward in a direction perpendicular to the support plate 32B.

The clinchers 31B, 31C are plate members of the same shape, which are symmetrically arranged to laterally oppose each other. The clincher 31B has a recess 31*b* provided on an edge thereof opposing the clincher 31C, a protrusion 31*d* provided above the recess 31*b*, a claw portion 31*f* provided above the protrusion 31*d* but on a side thereof away from the clincher 31C, a recess 31*h* provided on a lower edge of the clincher 31B, and a protrusion 31*j* provided below the recess 31*b* and protruding toward the clincher 31C.

The clincher 31C has a recess 31*c* provided on an edge thereof opposing the clincher 31B, a protrusion 31*e* provided above the recess 31*c*, a claw portion 31*g* provided above the protrusion 31*e* but on a side thereof away from the clincher 31B, a recess 31*i* provided on a lower edge of the clincher 31C, and a protrusion 31*k* provided below the recess 31*c* and protruding toward the clincher 31B.

The protrusions 31*d*, 31*e* protrude upward relative to an upper end of the support plate 32B. As shown in FIG. 8C, the protrusion 31*j* protrudes more toward the clincher 31C than an edge portion 31*m* above the recess 31*b*. The protrusion 31*k* protrudes more toward the clincher 31B than an edge portion 31*n* above the recess 31*c*. The edge portions 31*m*, 31*n* are inclined in such a direction that the edge portions 31*m*, 31*n* are farther away from each other as they go upward.

The support plate 32B is fixed to the binding unit 3A, as shown in FIG. 4, to be parallel to the front surface of the binding unit 3A. As shown in FIG. 6, the support plate 32B has an opening 32*a* provided at the center of the support plate 32B and configured to allow the cutting portion 30A to come in and out while moving forward and backward, and claw portions 32*b*, 32*c* provided near to upper ends of both sides of the support plate 32B. The claw portion 32*b* is connected with the claw portion 31*f* on the upper end of the clincher 31B via a spring 32*d*, and the claw portion 32*c* is connected with the claw portion 31*g* on the upper end of the clincher 31C via a spring 32*e*.

In a state where the clinchers 31B, 31C are separated from each other, the cutting portion 30A protrudes through the opening 32*a* of the support plate 32B and thus is positioned at a first position, where the cutting portion 30A is advanced into an operation region of the clinchers 31B, 31C on the front surface side thereof. In a state where the clinchers 31B, 31C are close to each other, the cutting portion 30A is retracted into the opening portion 32*a* and thus is positioned at a second position, where the cutting portion 30A is retracted from the operation region of the clinchers 31B, 31C.

The clincher links 33B, 33C are plate members of the same shape, which are symmetrically arranged to laterally oppose each other. The clincher link 33B is pivotally supported on the binding unit 3A about a shaft member (not shown) inserted through a pivot hole 33*b*. The clincher link 33B is configured to movably support the clincher 31B relative to the support plate 32B. The clincher link 33B has a protrusion 33*d* inserted in the recess 31*h* and then protruding toward the front surface side, a protrusion 33*f* protruding from a location thereon opposing the clincher link 33C, a recess 33*h* adjacent to a rear surface side of the protrusion 33*f*, a protrusion 33*j* adjacent to a rear surface side of the recess 33*h*, an inclined portion 33*m* obliquely cut out in such a direction that the inclined portion 33*m* is farther away from the clincher link 33C as it goes from the protrusion 33*j* toward the rear surface side, and a protrusion 33*o* adjacent to a rear surface side of the inclined portion 33*m*.

The clincher link 33C is pivotally supported on the binding unit 3A about a shaft member (not shown) inserted through a pivot hole 33*c*. The clincher link 33C is configured to movably support the clincher 31C relative to the support plate 32B. The clincher link 33C has a protrusion 33*e* inserted in the recess 31*i* and then protruding toward the front surface side, a protrusion 33*g* protruding from a location thereon opposing the clincher link 33B, a recess 33*i* adjacent to a rear surface side of the protrusion 33*g*, a protrusion 33*k* adjacent to a rear surface side of the recess 33*i*, an inclined portion 33*n* obliquely cut out in such a direction that the inclined portion 33*n* is farther away from the clincher link 33B as it goes from the protrusion 33*k* toward the rear surface side, and a protrusion 33*p* adjacent to a rear surface side of the inclined portion 33*n*.

As the moving shafts 30*f*, 30*g* moves forward and backward, locations where the clincher link 33B comes in contact with the protrusions 30*m*, 30*o* are changed and thus the clincher link 33B are pivoted. Also, as the moving shafts 30*f*, 30*g* moves forward and backward, locations where the clincher link 33C comes in contact with the protrusions 30*n*, 30*p* are changed and thus the clincher link 33C are pivoted.

The pressing portion 34B is provided at a location where the pressing portion 34B covers over the cutting portion 30A and the support plate 32B. The pressing portion 34B has a pressing plate 34*a* provided over the cutting portion 30A and the support plate 32B, a pivot shaft 34*b* for the pressing plate 34*a*, and support members 34*c* for the pivot shaft 34*b*.

The pressing plate 34A protrudes from above the opening 32*a* toward the front surface side. When the clincher 31B, 31C are positioned at an initial position where the clinchers 31B, 31C are away from each other, a space is formed the pressing plate 34*a* and the upper end of the support plate 32B.

Figure 7A:
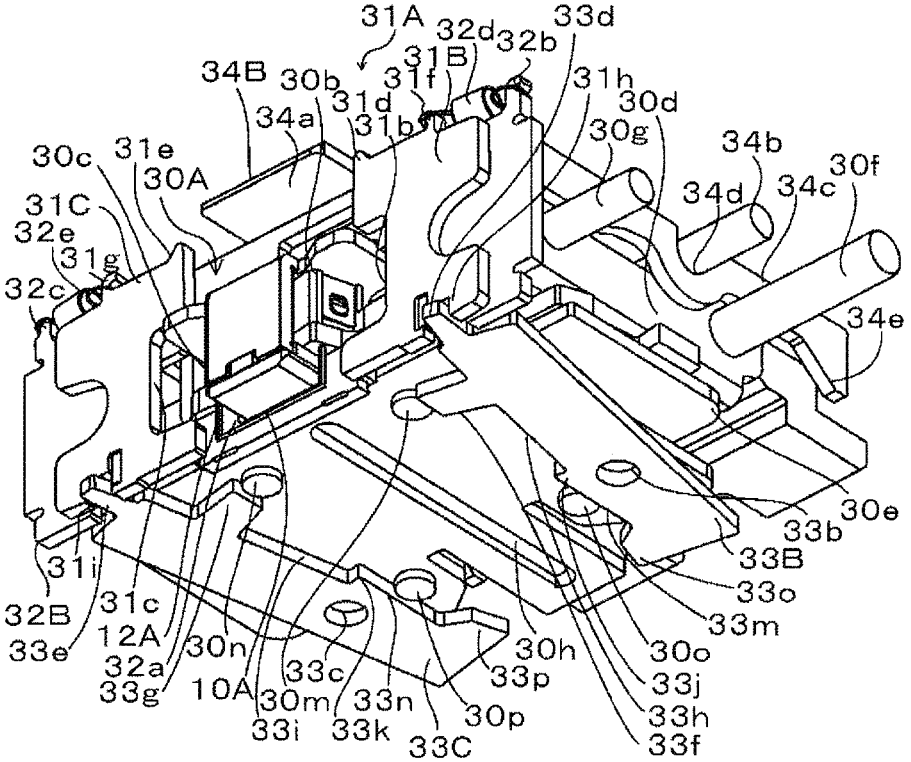
FIGS. 7A to 7C are explanatory views showing an exemplary operation of the cutting portion and the clincher portion.
Figure 7B:
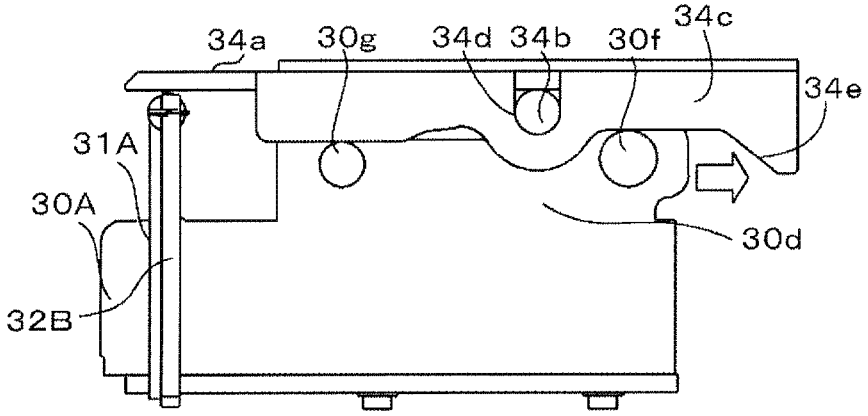

As shown in FIG. 7B, the pivot shaft 34*b* is provided to be parallel to the moving shafts 30*f*, 30*g* at a location where the pivot shaft 34*b* is sandwiched between the cutting portion 30A and the pressing plate 34*a*.

The support members 34*c* have a hole portion 34*d* for pivotally supporting the pivot shaft 34*b*, and an inclined portion 34*e* provided more toward the rear surface side than the hole portion 34*d* and inclined downward as it goes toward the rear surface side. The support members 34*c* are integrated with the pressing plate 34*a* to be pivoted about the pivot shaft 34*b*. Thus, the cutting portion 30A and the clincher portion 31A are operatively connected to each other via the clincher links 33B, 33C.

Exemplary Operation of Stapler of the Present Embodiment

In FIG. 7A, sheets of paper P are omitted for convenience of explanation, but a state, where as shown in FIG. 3C, staple legs 12A of a staple 10A penetrating sheets of paper P are cut into a predetermined length suitable to the number of sheets of paper P by the staple leg cutting members 30*b*, 30*c* of the cutting portion 30A, is shown. This state is a state where the cutting portion 30A is moved farthest toward the front surface side and also the inclined portion 34*e* and the moving shaft 30*f* are positioned to be farthest away from each other. The cutting portion 30A is positioned at the first position, where the cutting portion 30A is advanced through the opening 32*a* of the support plate 32B into the operation region of the clinchers 31B, 31C on the front surface side. The recess 31*b* of the clincher 31B and the recess 31*c* of the clincher 31C are moved aside from the cutting portion 30A.

As shown in FIG. 7A, the protrusion 30*m* of the support plate 30*e* is in contact with a distal end of the protrusion 33*f* of the clincher link 33B, and the protrusion 30*o* is in contact with the inclined portion 33*m* to be close to the protrusion 33*j*. The protrusion 30*n* of the support plate 30*e* is in contact with a distal end of the protrusion 33*g* of the clincher link 33C, and the protrusion 30*p* is in contact with the inclined portion 33*n* to be close to the protrusion 33*k*. Since the protrusion 33*d* of the clincher link 33B and the protrusion 33*e* of the clincher link 33C are positioned to be farthest away from each other, the clinchers 31B, 31C are also positioned to be farthest away from each other.

Figure 7C:
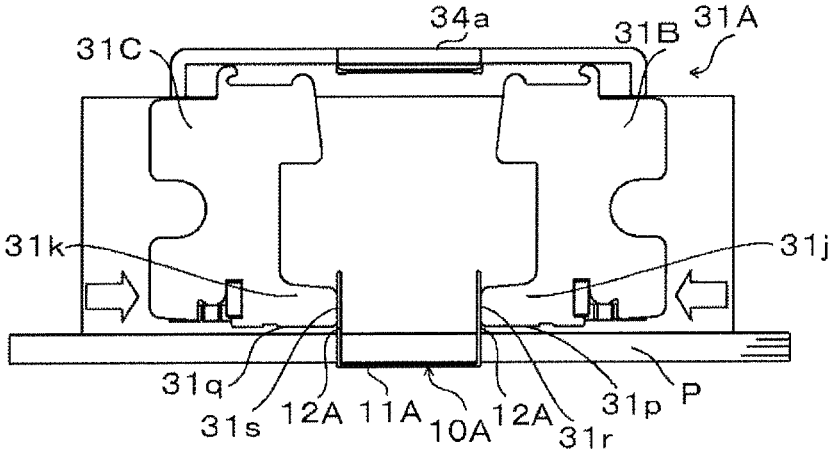

The sheets of paper P are clamped by the paper clamping portion 4A shown in FIG. 4, and as shown in FIG. 7C, the staple crown 11A of the staple 10A is positioned below the sheets of paper P. The staple legs 12A protrude upward relative to the sheets of paper P and also protrude upward relative to the protrusions 31*j*, 31*k* of the clinchers 31B, 31C. A lower surface 31*p* of the protrusion 31*j* of the clincher 31B and a lower surface 31*q* of the protrusion 31*k* of the clincher 31C are positioned to be parallel to the surface of the sheets of paper P. Opposing edges 31*r*, 31*s* of the protrusion 31*j* and the protrusion 31*k* are positioned to be perpendicular to the surface of the sheets of paper P.

When the drive unit 5A shown in FIG. 4 drives the cam 51A, an operation of the cam 51A is transferred to the moving shaft 30*f*, 30*g* via the link portion 52A and a link member (not shown). Therefore, as shown by an outlined arrow in FIG. 7B, the drive unit 5A moves the moving shafts 30*f*, 30*g* in a direction perpendicular to the support plate 32B so that the moving member 30*d* approaches the inclined portion 34*e*.

Figure 8A:
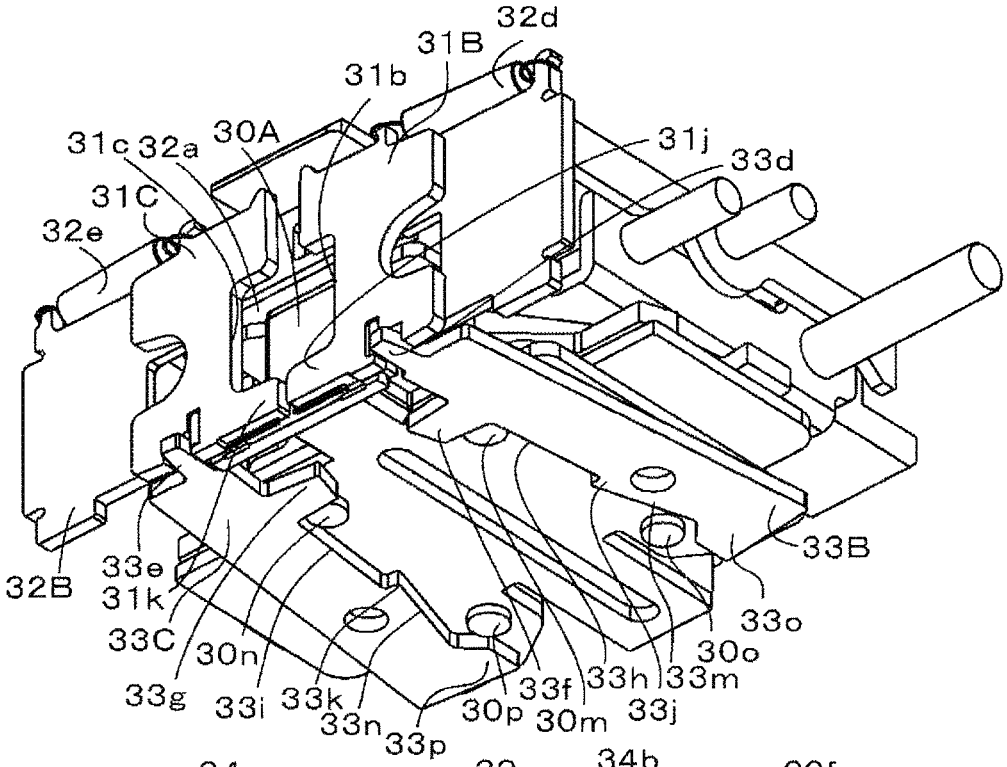
FIGS. 8A to 8C are explanatory views showing an exemplary operation of the cutting portion and the clincher portion.

As the moving shafts 30*f*, 30*g* are moved toward the rear surface side in the direction perpendicular to the support plate 32B, the cutting portion 30A are moved more rearward than the opening 32*a* of the support plate 32B as shown in FIG. 8A. When the moving shaft 30*f* and the inclined portion 34*e* approach each other as shown in FIG. 8B, the cutting portion 30A is moved to the second position, where the cutting portion 30A is retracted from the operation region of the clinchers 31B, 31C, as shown in FIG. 8A.

As the moving member 30*d* is moved, locations where the clincher links 33B, 33C come in contact with the protrusions 30*m*, 30*n*, 30*o*, 30*p* of the support plate 30*e* are changed. The protrusion 30*m* is in contact with a side surface of the protrusion 33*f* facing the recess 33*h*, and the protrusion 30*o* is positioned close to the inclined portion 33*m* and the protrusion 33*o*. The protrusion 30*n* is in contact with a side surface of the protrusion 33*g* facing the recess 33*i*, and the protrusion 30*p* is positioned close to the inclined portion 33*n* and the protrusion 33*p*.

Figure 8B:
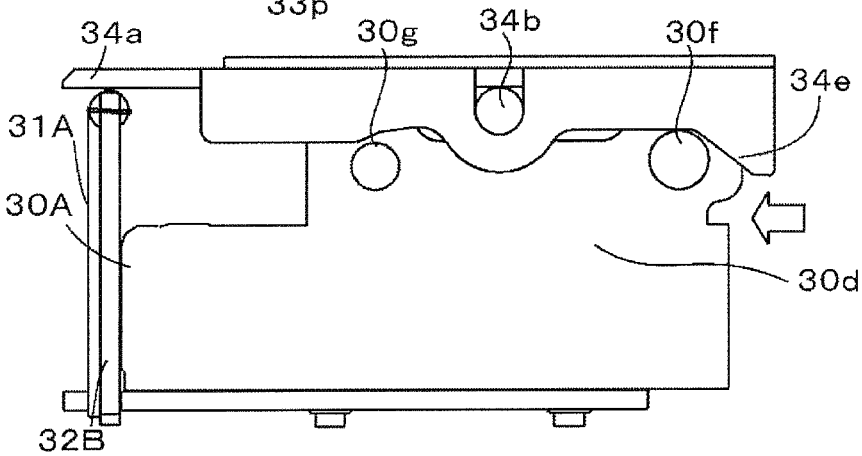
Figure 8C:
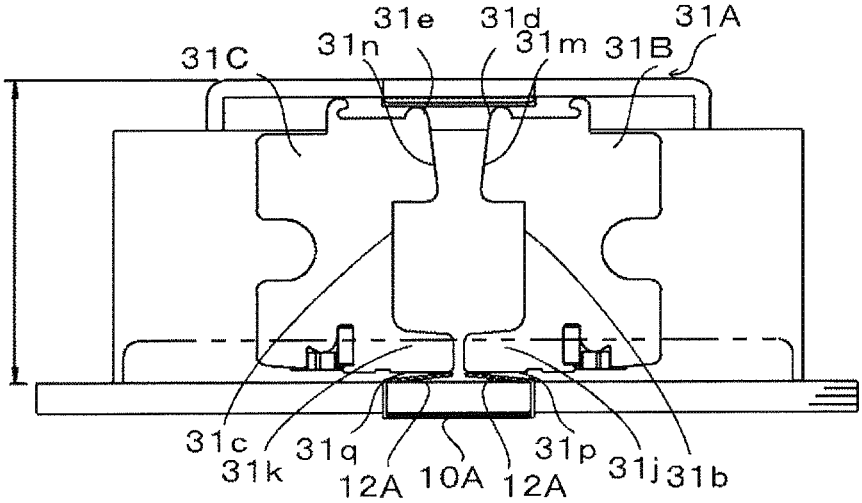

In particular, as the protrusion 30*m* is moved from the state, where the protrusion 30*m* is in contact with the distal end of the protrusion 33*f* as shown in FIG. 7A, to the state, where the protrusion 30*m* is in contact with the side surface of the protrusion 33*f* facing the recess 33*h* as shown in FIG. 8B, the protrusion 33*d* is pivoted to be close to the clincher link 33C. Therefore, as shown by an outlined arrow in FIG. 7C, the clincher 31B is moved along a surface direction of the sheets of paper P to approach the clincher 31C. Also, as the protrusion 30*n* is moved from the state, where the protrusion 30*n* is in contact with the distal end of the protrusion 30*g* as shown in FIG. 7A, to the state, where the protrusion 30*n* is in contact with the side surface of the protrusion 30*g* facing the recess 33*i* as shown in FIG. 8B, the protrusion 33*e* is pivoted to be close to the clincher link 33B. Therefore, as shown by an outlined arrow in FIG. 7C, the clincher 31C is moved along a surface direction of the sheets of paper P to approach the clincher 31B.

As the clinchers 31B, 31C approach each other, a distance between the claw portion 31*f* and the claw portion 32*b* is increased to stretch the spring 32*d*, and a distance between the claw portion 31*g* and the claw portion 32*c* is increased to stretch the spring 32*e*.

In this way, a first operation, in which the clinchers 31B, 31C approach each other along the surface direction of the sheets of paper P, is performed in accordance with movement of the cutting portion 30A from the first position to the second position. Due to the first operation, the protrusions 31*j*, 31*k* bend the staple legs 12A toward the surface direction of the sheets of paper P as shown in FIG. 8C. The sheets of paper P and the lower surface 31*p* of the protrusion 31*j* of the clincher 31B become parallel to each other, and also the sheets of paper P and the lower surface 31*q* of the protrusion 31*k* of the clincher 31C become parallel to each other. The lower surfaces 31*p*, 31*q* are slightly spaced from the sheets of paper P. Therefore, the distal ends of the staple legs 12A are also bent to be slightly spaced from the sheets of paper P.

When the drive unit 5A shown in FIG. 4 further drives the cam 51A, an operation of the cam 51A is transferred to the moving shaft 30*f*, 30*g* via the link portion 52A and the link member (not shown). If the operation of the cam 51A is transferred to the moving shafts 30*f*, 30*g*, as shown by an outlined arrow in FIG. 9B, the moving member 30*d* is further moved toward the rear surface side in the direction perpendicular to the support plate 32B. Due to the movement of the moving member 30*d*, the moving shaft 30*f* pushes up the inclined portion 34*e* and thus as shown by an one-dotted chain line arrow in FIG. 9B, the pressing plate 34*a* is pivoted about the pivot shaft 34*b* in a direction toward the clincher portion 31A while being integrated with the support members 34*c*

As the pressing plate 34*a* is pivoted, the pressing plate 34*a* presses the protrusion 30*d* of the clincher 31B and the protrusion 31*e* of the clincher 31C as shown in FIG. 10A. As a result, the clinchers 31B, 31C approach the sheets of paper P, and thus a second operation, in which the clinchers 31B, 31C are pivoted along the support plate 32B so that the protrusions 31*d*, 31*e* approach each other, is performed.

FIG. 10B is a detailed view of a section I in FIG. 10A. As shown in FIG. 10B, a pivot fulcrum 31*t* of the clincher 31B is a pivot fulcrum, as which a point thereon in contact with the corresponding staple leg 12A serves, and is located on the lower surface 31*p* of the protrusion 31*j* in contact with one staple leg 12Ab. The pivot fulcrum 31*t* is a point near to a root of the bent staple leg 12Ab and is located more toward a distal end of the staple leg 12Ab than an inner side 12*a* of the root of the staple leg 12Ab. The lower surface 31*p* presses a region of the staple leg 12Ab ranging from the pivot fulcrum 31*t* to the distal end thereof while being pivoted, so that the staple leg 12Ab is bent to extend along the surface direction of the sheets of paper P.

A pivot fulcrum 31*u* of the clincher 31C is a pivot fulcrum, as which a point thereon in contact with the corresponding staple leg 12A serves, and is located on the lower surface 31*q* of the protrusion 31*k* in contact with the other staple leg 12Ac. The pivot fulcrum 31*u* is a point near to a root of the bent staple leg 12Ac and is located more toward a distal end of the staple leg 12Ac than an inner side 12*b* of the root of the staple leg 12Ac. The lower surface 31*q* presses a region of the staple leg 12Ac ranging from the pivot fulcrum 31*u* to the distal end thereof while being pivoted, so that the staple leg 12Ac is bent to extend along the surface direction of the sheets of paper P. A width between the pivot fulcrums 31*t*, 31*u*, i.e., a distance between the pivot fulcrums is set to be narrower than a width between inner sides 12*a*, 12*b* of the staple crown 11A shown in FIG. 3A. Therefore, as the staple legs 12Ab, 12Ac are bent to extend along the surface direction of the sheets of paper P, the staple legs 12A penetrating the sheets of paper P are bent as shown in FIG. 3D, so that the sheets of paper P are bound with the staple 10A. At this time, the clinchers 31B, 31C are in contact with a region of the respective staple legs 12A of the staple, which penetrate the sheets of paper P and are bent, ranging from the pivot fulcrums 31*t*, 31*g* to the distal ends thereof.

In the state where the protrusions 31*d*, 31*e* are pressed by the pressing plate 34*a*, as shown in FIG. 10A, the spring 32*d* which urges the claw portion 31*f* of the clincher 31B toward the claw portion 32*b* of the support plate 32B is further stretched, and the spring 32*e* which urges the claw portion 31*g* of the clincher 31C toward the claw portion 32*c* of the support plate 32B is further stretched.

When an operation of bending the staple legs 12A is completed, the drive unit 5A shown in FIG. 4 drives the cam 51A, and an operation of the cam 51A is transferred to the moving shafts 30*f*, 30*g* via the link portion 52A and the link member (not shown). As the moving shafts 30*f*, 30*g* are moved, the moving member 30*d* is moved to approach the support plate 32B in a direction perpendicular thereto as shown by a solid arrow in FIG. 9B. Pushing up of the inclined portion 34*e* by the moving shaft 30*f* is released, and thus the pressing plate 34*a* is pivoted about the pivot shaft 34*b* in a direction opposite to the one-dotted chain line arrow in FIG. 9B while being integrated with the support members 34*c*, and is moved away from the clincher portion 31A.

When the pressing plate 34*a* is separated from the protrusion 31*d* of the clincher 31B and the protrusion 31*e* of the clincher 31C, the stretched springs 32*d*, 32*e* try to contract as shown by an outlined arrow in FIG. 10A. Due to tensile forces of the springs 32*d*, 32*e*, the clincher 31B and the clincher 31C, which have pressed the staple legs 12A toward the sheets of paper P, are pivoted about the pivot fulcrums 31*t*, 31*u* in directions separating from the staple legs 12A as shown by solid arrows in the figure. As shown in FIG. 8C, the sheets of paper P and the lower surface 31*p* of the protrusion 31*j* of the clincher 31B become parallel to each other, and also the sheets of paper P and the lower surface 31*q* of the protrusion 31*k* of the clincher 31C become parallel to each other.

The drive unit 5A shown in FIG. 4 drives the cam 51A and thus moves the moving shafts 30*f*, 30*g* in a direction perpendicular to and approaching the support plate 32B, as shown by an outlined arrow in FIG. 8B, via the link portion 52A and the link member (not shown). As the moving shafts 30*f*, 30*g* are moved in the direction approaching the support plate 32B, the moving member 30*d* is separated from the inclined portion 34*e*.

As the moving member 30*d* is moved, the stretched springs 32*d*, 32*e* shown in FIG. 8A try to contract. Due to forces which are caused by the springs 32*d*, 32*e* trying to contract, the clinchers 31B, 31C are pulled in directions away from each other.

As the moving member 30*d* are moved, the clincher links 33B, 33C are pivoted so that locations where the clincher links 33B, 33C come in contact with the protrusions 30*m*, 30*n*, 30*o*, 30*p* of the support plate 30*e* are changed.

As the clincher links 33B, 33C are pivoted, the protrusion 33*d* of the clincher link 33B and the protrusion 33*e* of the clincher link 33C are moved to be away from each other. Thus, the clincher 31B and the clincher 31C are moved along the surface direction of the sheets of paper P in a direction opposite to the outlined arrow in FIG. 7C, so that the clincher 31B and the clincher 31C are away from each other. Further, as the moving shafts 30*f*, 30*g* are moved toward the front surface side in a direction perpendicular to the support plate 32B, the cutting portion 30A are moved toward the front surface side though the opening 32*a* of the support plate 32B as shown in FIG. 7A.

Then, the drive unit 5A stops moving the moving shafts 30*f*, 30*g* at a position where the moving shaft 30*f* and the inclined portion 34*e* are farthest away from each other as shown in FIG. 7A. The protrusion 30*m* comes in contact with the distal end of the protrusion 33*f*, and the protrusion 30*o* comes in contact with the inclined portion 33*m* to be close to the protrusion 33*j*. The protrusion 30*n* comes in contact with the distal end of the protrusion 33*g*, and the protrusion 30*p* is in contact with the inclined portion 33*n* to be close to the protrusion 33*k*.

In particular, as shown in FIG. 8A, since the protrusion 30*o* is moved from the vicinity of the protrusion 33*o* to the vicinity of the protrusion 33*j*, the clincher link 33B is pivoted so that the protrusion 30*o* follows the inclined portion 33*m*, and also the clincher link 33B is moved until the protrusion 30*m* comes in contact with the distal end of the protrusion 33*f*.

Further, since the protrusion 30*p* is moved from the vicinity of the protrusion 33*p* to the vicinity of the protrusion 33*k*, the clincher link 33C is pivoted so that the protrusion 30*p* follows the inclined portion 33*n*, and also the clincher link 33C is moved until the protrusion 30*n* comes in contact with the distal end of the protrusion 33*g*.

Therefore, the protrusion 33*d* of the clincher link 33B and the protrusion 33*e* of the clincher link 33C are positioned to be farthest away from each other, and thus the clincher 32B and the clincher 33C are positioned to be farthest from each other. Also, the cutting portion 30A is moved to the first position where the cutting portion 30A is advanced into the operation region of the clinchers 31B, 31C. Accordingly, the cutting portion 30A and the clincher portion 31A operates together by the clincher links 33B, 33C operatively connecting the cutting portion 30A with the clincher portion 31A.

Exemplary Operation and Effects of Stapler of the Present Embodiment

The stapler 1A of the present embodiment is configured to bend the staple legs 12A by the first and second operations which move the clinchers 31B, 31C. Therefore, the pivot fulcrum 31*t* of the clincher 31B and the pivot fulcrum 31*u* of the clincher 31C can be provided at locations which are close to the sheets of paper P and at which they come in contact the staple legs 12Ab, 12Ac. As a result, the staple 1A can keep a height of clincher portion 31A lower, thereby achieving downsizing thereof.

According to the stapler 1A, a distance between the pivot fulcrums 31*t*, 31*u* of the clinchers 31B, 31C during the second operation is set to be narrower than a distance between the inner sides 12*a*, 12*b*, which is an inner width of the staple crown 11A of the staple 1A penetrating the sheets of paper P. Therefore, during the second operation, the lower surface 31*p* presses a region of the staple leg 12Ab ranging from the pivot fulcrum 31*t* to the distal end thereof, and thus the staple legs 12Ab is bent to extend along the surface direction of the sheets of paper P. Also, during the second operation, the lower surface 31*q* presses a region of the staple leg 12Ac ranging from the pivot fulcrum 31*u* to the distal end thereof, and thus the staple legs 12Ac is bent to extend along the surface direction of the sheets of paper P.

Thus, a contact length between the clinchers 31B, 31C and the staple legs 12A is increased. As a result, it is possible to properly bend the staple legs 12A onto the surface of the sheets of paper P, thereby inhibiting a poor binding, such as buckling, reverse bending, rising-up of staple legs or lifting of staple legs, and thus realizing a stabilized bent shape of the staple legs 12A.

Further, an operation in which the cutting portion 30A moves forward and backward between the first position, where the cutting portion 30A is advanced into the operation region of the clinchers 31B, 31C, and the second position, where the cutting portion 30A is retracted from the operation region of the clinchers 31B, 31C, an operation in which the clinchers 31B, 31C approach and separate from each other, and an operation in which the clinchers 31B, 31C approach the sheets of paper P, are operatively connected together. As a result, it is possible to keep a height of the clincher portion 31A lower without causing the cutting portion 30A and the clinchers 31B, 31C to interfere with each other, thereby achieving downsizing.

Meanwhile, although in the present embodiment, the cutting portion 30A is operatively connected to the clincher portion 31A by the clincher links 33B, 33C and thus the clincher portion 31A is moved in accordance with movement of the cutting portion 30A, the present invention is not limited thereto. The cutting portion 30A and the clincher portion 31A may be separately connected to the link portion 52A via different link members (not shown), so that the an operation of the cam 51A moves the clincher portion 31A via the link portion 52A, the link members (not shown) or the like, but not via the cutting portion 30A. Also, if the stapler 1A is configured such that staples 10A suitable to the number of sheets of paper P are loaded therein, the cutting portion 3A and the cut staple receiving portion 6A may be omitted.

Although in the present embodiment, an operation of the cam 51A is transferred to the moving shafts 30*f*, 30*g*, the present invention is not limited thereto. The pivot shaft 34*b* may be connected to the link portion 52A via a link member (not shown), so that the operation of the cam 51A is also transferred to the pivot shaft 34*b*.

Since the stapler 1A has the cut staple receiving portion 6A, the cut staples 13A can be received in the cut staple receiving portion 6A, regardless of positions of the stapler 1A inside the post-processing device 502A. Alternatively, the present invention is not limited to the configuration in which the cut staple receiving portion 6A is provided in the stapler 1A, and accordingly, the post-processing device 502A may be provided with a receiving portion for receiving the cut staples 13A.

The present invention is very suitable to be applied to a stapler equipped in a post-processing divide of an image formation device, to a post-processing equipped with the stapler, and also to an image formation divide equipped with the post-processing device.

1A Stapler
10A Staple
11A Staple crown
12A(12Ab, 12Ac) Staple leg
13A Cut staple
2A Staple striking unit
20A Receiving portion
21A Feeding portion
22A Striking portion
3A Binding unit
30A Cut portion
31A Clincher portion
31B, 31C Clincher
32A Shaft
33A(33$A_L$, 33AR) Discharging path
34$A_L$, 34$A_R$ Discharging port
4A Paper clamping portion
5A Drive unit
50A Motor
51A Cam
52A Link portion
6A Cut staple receiving unit
60$A_L$, 60$A_R$ Collecting path

61$A_L$, 61$A_R$ Collecting port
100A Staple cartridge

The invention claimed is:

1. A stapler comprising:

a staple striking portion configured to strike a staple to penetrate sheets of paper;

a clincher portion comprising a pair of clinchers and configured to bend staple legs of the staple penetrating the sheets of paper;

a pressing portion configured to press the pair of clinchers while the pair of clinchers are close to each other, wherein the pair of clinchers are configured to perform a first operation and a second operation, wherein in the first operation, the pair of the clinchers move along a surface direction of the sheets of paper to approach each other, wherein in the second operation, the pair of clinchers move to approach the sheets of paper after the first operation, and wherein each of the pair of clinchers comprises a first protrusion along a first edge, and wherein the pressing portion presses the pair of clinchers at each respective first protrusion to cause pivoting of each of the pair of clinchers about a point, and the point of each of the pair of clinchers abuts against a respective one of the staple legs.

2. The stapler according to claim 1, wherein in the second operation, a distance between the points of the pair of clinchers is narrower than an inner width of a staple crown of the staple penetrating the sheets of paper.

3. The stapler according to claim 2, wherein in the second operation, the clincher comes in contact with a region of the staple leg of the staple, which penetrates the sheets of paper, ranging from the point of the clincher to a distal end of the staple leg.

4. The stapler according to claim 1, further comprising:

a cutting portion configured to cut the staple legs of the staple penetrating the sheets of paper; and a clincher link configured to operatively connect the cutting portion with the clincher portion.

5. The stapler according to claim 4, wherein the cutting portion is configured to move to:

a first position where the cutting portion is advanced into an operation region of the pair of clinchers; and a second position where the cutting portion is retracted from the operation region of the pair of clinchers; and wherein the pair of clinchers are configured to perform the first operation in accordance with a movement of the cutting portion from the first position to the second position.

6. The stapler according to claim 5, wherein the clincher link comprises a pair of clincher links, wherein each of the clincher links is configured to movably support each of the clinchers, and wherein in accordance with the movement of the cutting portion from the first position to the second position, the pair of the clincher links are pivoted to be closed to each other, and the pair of clinchers are configured to perform the first operation.

7. The stapler according to claim 6, wherein each of the clincher links comprises:

a protrusion protruding from a location where the pair of the clincher links are opposed to each other; and a recess adjacent to the protrusion, wherein the cutting portion comprises the pair of the protrusions, wherein each of the protrusions of the cutting portion is in contact with the protrusion or the recess of each of the clincher links, and wherein in accordance with the movement of the cutting portion from the first position to the second position, the protrusions of the cutting portion move from a state, where the protrusions of the cutting portion are in contact with the protrusions of the clincher links, to a state, where the protrusions of the cutting portion are in contact with the recesses of the clincher links, and the pair of the clincher links are pivoted to be closed to each other.

8. The stapler according to claim 4, wherein the cutting portion is configured to move to:

a first position where the cutting portion is advanced into an operation region of the pair of clinchers;

a second position where the cutting portion is retracted from the operation region of the pair of clinchers;

a third position where the cutting portion is retracted from the second position, and wherein the pair of clinchers are configured to perform the second operation in accordance with a movement of the cutting portion from the second position to the third position.

9. The stapler according to claim 8, wherein in accordance with the movement of the cutting portion from the second position to the third position, the pressing portion is configured to press the pair of the clincher links, and the pair of clinchers are configured to perform the second operation.

10. The stapler according to claim 9, wherein the pressing portion comprises an inclined portion, wherein the cutting portion comprises a shaft portion, and wherein in accordance with the movement of the cutting portion from the second position to the third position, the shaft portion of the cutting portion is configured to push the inclined portion of the pressing portion, and the pressing portion is pivoted in a direction toward the pair of the clincher.

11. The stapler according to claim 4, wherein the clincher portion further comprises a support plate for movably supporting the pair of clinchers.

12. The stapler according to claim 11, wherein the pressing portion covers the cutting portion and the support plate.

13. The stapler according to claim 1, further comprising:

a cam;

a link portion; and a motor, wherein the motor is configured to rotate the cam, and wherein the link portion is configured to transfer operation of the cam to the staple striking portion and the clincher portion.

14. The stapler according to claim 1, wherein a first clincher of the pair of clinchers comprises a first plate member of a same shape as a second plate member of a second clincher of the pair of clinchers, and the first clincher laterally opposes the second clincher.

15. The stapler according to claim 14, wherein the first clincher further comprises a first recess on a second edge, and the second edge opposes the second clincher.

16. The stapler according to claim 15, wherein the first clincher further comprises a second protrusion positioned along the second edge, and the second protrusion extends from a third edge of the first clincher to the first recess, wherein the third edge of the first clincher abuts a respective one of the stapler legs and on an opposite side from the first edge of the first clincher.

17. The stapler according to claim 16, wherein the first clincher further comprises a second recess along the third edge, and the second recess is closer to a fourth edge of the first clincher than to the second edge of the first clincher, wherein the fourth edge is on an opposite side from the second edge of the first clincher.

18. The stapler according to claim 14, wherein the first clincher further comprises a claw on the first edge.

* * * * *